US008055175B2

(12) United States Patent
Sugaya

(10) Patent No.: US 8,055,175 B2
(45) Date of Patent: Nov. 8, 2011

(54) IMAGE HEATING APPARATUS

(75) Inventor: Kenjirou Sugaya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 12/570,726

(22) Filed: Sep. 30, 2009

(65) Prior Publication Data

US 2010/0086335 A1 Apr. 8, 2010

(30) Foreign Application Priority Data

Oct. 2, 2008 (JP) ..... 2008-257338

(51) Int. Cl.
*G03G 15/20* (2006.01)

(52) U.S. Cl. ..... 399/329

(58) Field of Classification Search ..... 399/122, 399/124, 328, 329
See application file for complete search history.

(56) References Cited

U.S. PATENT DOCUMENTS

| | | | | |
|---|---|---|---|---|
| 6,845,226 | B2 * | 1/2005 | Tatematsu et al. | 399/329 |
| 7,107,001 | B2 * | 9/2006 | Kameda | 399/328 |
| 7,200,354 | B2 * | 4/2007 | Nakamoto et al. | 399/329 |
| 2006/0210288 | A1 * | 9/2006 | Hayashi et al. | 399/33 |
| 2007/0217838 | A1 * | 9/2007 | Yamana et al. | 399/328 |
| 2008/0118282 | A1 | 5/2008 | Takagi et al. | |

FOREIGN PATENT DOCUMENTS

| | | | |
|---|---|---|---|
| JP | 59-33787 | | 2/1984 |
| JP | 2000-29332 | | 1/2000 |
| JP | 2000-181258 | | 6/2000 |
| JP | 2002-148983 | | 5/2002 |
| JP | 2003-122148 | | 4/2003 |
| JP | 2007-57786 | | 3/2007 |
| JP | 2007-057786 | * | 3/2007 |
| JP | 2008-122771 | | 5/2008 |

OTHER PUBLICATIONS

Chinese Office Action dated Mar. 24, 2011, in counterpart Chinese Application No. 200910177493.5, and English-language translation thereof.

* cited by examiner

*Primary Examiner* — Sandra Brase
(74) *Attorney, Agent, or Firm* — Fitzpatrick, Cella, Harper & Scinto

(57) ABSTRACT

An image heating apparatus includes a coil for generating magnetic flux, a belt including an electroconductive layer for generating heat by the magnetic flux generated from the coil, for heating an image on a recording material by the heat generated by the electroconductive layer, a first pressing member contactable to an inner surface of the belt member, a second pressing member for pressing the belt member against the first pressing member to nip and convey the recording material, a coil unit, including the coil, provided oppositely to an outer surface of the belt member, a mover moving the coil unit between a first position in which the image on the recording material is to be heated and a second position in which the coil unit is moved away from the belt member, and a pressure changer changing the pressure between the first and second pressing members.

10 Claims, 9 Drawing Sheets

IMAGE HEATING APPARATUS

FIELD OF THE INVENTION AND RELATED ART

The present invention relates to an image heating apparatus suitable for use as an image fixing device to be mounted in an image forming apparatus such as an electrophotographic copying machine or an electrophotographic printer.

As the fixing device to be mounted in the electrophotographic copying machine or printer, an induction heating type image fixing device has been known and is described in Japanese Laid-Open Patent Application (JP-A) 2000-181258 and JP-A 2000-29332. In this fixing device, a magnetic field generated by a magnetic field generating means is caused to act on a heating member having an electroconductive layer to heat the heating member by the action of electromagnetic induction. Further, by using a thin belt as the heating member, the fixing device has the advantage that the thermal capacity can be reduced and thermal responsibility is excellent.

In the case of the fixing device of the induction heating type, the magnetic field generating means can be provided not only inside the heating member but also outside the heating member so long as it can exert the magnetic field on the heating member, so that the magnetic field generating means can be disposed at an arbitrary pressure depending on the constitution of the fixing device. The above-described induction heating type fixing device has the advantage that only a desired portion is selectively and instantaneously heated by disposing the magnetic field generating means at the arbitrary position with respect to the heating member and by exerting the magnetic field on only a portion intended to be heated.

Further, as a fixing device that meets the need for energy saving in recent years, an induction heating type fixing device utilizing high-frequency induction as a heating source has been proposed (JP-A Sho 59-33787). In this induction heating type fixing device, a coil is disposed concentrically outside a thin fixing roller formed of a metal conductor. An induced eddy current is generated in the fixing roller by a high-frequency magnetic field generated by passing a high-frequency current through the coil, so that the fixing roller itself is heated through Joule heat by the skin resistance of the fixing roller itself. According to the induction heating type fixing device, the electro-thermal conversion efficiency can be improved, so that it is possible to reduce the warm-up time from the start of energization to the coil to the time when the temperature of the fixing roller reaches a predetermined temperature.

Further, a belt fixing device of the induction heating type in which the fixing roller is replaced with a thin sleeve-like fixing belt has also been proposed (JP-A 2002-148983). By this fixing device, the thermal capacity of the fixing belt can be suppressed and it is also possible to reduce the warm-up time.

In the belt fixing device of the induction heating type, an auxiliary pressing member is provided inside a cylindrical flexible fixing belt having an electroconductive layer and the fixing belt is nipped between the auxiliary pressing member and a pressing member by pressing the auxiliary pressing member to form a nip between the pressing member and the fixing belt. The cross-sectional shape of the fixing belt at that time is changed from the cylindrical (circular) shape to a partly flattened elliptical shape since the fixing belt is nipped between the auxiliary pressing member and the pressing member. Outside the fixing belt a coil unit provided with a coil is provided. In order to increase the heat generating efficiency of the fixing belt through the induction heating, the cross-sectional shape of the coil unit on the fixing belt side is partly flattened so as to follow the shape of the fixing belt, so that the distance (gap) between the coil unit and the fixing belt is decreased. Further, the fixing belt and the coil unit are brought near to each other to dispose the fixing belt in an area in which a magnetic flux density is high, so that the heat generating efficiency of the fixing belt is increased.

In the case where jam clearance of a recording material is performed in the above-described belt fixing device, the jam clearance performed in a state in which the fixing belt and the pressing member are pressed by the auxiliary pressing member is a very cumbersome operation. Further, when the recording material is forcedly pulled off the fixing belt, the fixing belt is placed on a surface in which the fixing belt can be damaged. For that reason, in the case of performing the jam clearance, as described in JP-A 2007-57786, it is necessary to release a pressed state of the fixing belt and the pressing member (hereinafter referred to as a "pressure release").

However, in the above-described fixing device, in order to increase the heat generating efficiency of the fixing belt through the induction heating, the distance between the coil unit and the fixing belt is decreased. For that reason, in the pressure release state, the cross-sectional shape of the fixing belt is restored to the circular shape, so that there is a possibility that a fixing surface (outer peripheral surface) of the fixing belt contacts the coil unit. In this state, when the jam clearance is performed, there arises the problem that the fixing surface of the fixing belt is damaged.

SUMMARY OF THE INVENTION

A principal object of the present invention is to provide an image heating apparatus capable of avoiding contact between a belt member and a coil unit even when pressure exerted on the belt member and a pressing member is released and thus the shape of the belt member is changed.

According to an aspect of the present invention, there is provided an image heating apparatus comprising:

a coil for generating magnetic flux;

a belt member, including an electroconductive layer for generating heat by the magnetic flux generated from the coil, for heating an image on a recording material by the heat generated by the electroconductive layer;

a first pressing member contactable to an inner surface of the belt member;

a second pressing member for pressing the belt member against the first pressing member to nip and convey the recording material;

a coil unit, including the coil, provided oppositely to an outer surface of the belt member;

a moving mechanism capable of moving the coil unit between a first position in which the image on the recording material is to be heated and a second position in which the coil unit is moved away from the belt member; and a pressure changing mechanism for changing the pressure between the first pressing member and the second pressing member.

The pressure changing mechanism reduces the pressure between the first pressing member and the second pressing member in interrelation with the operation for moving the coil unit away from the belt member by the moving mechanism.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The present invention will be described with reference to the drawings.

Embodiment 1

(1) Image Forming Apparatus

Figure 1:
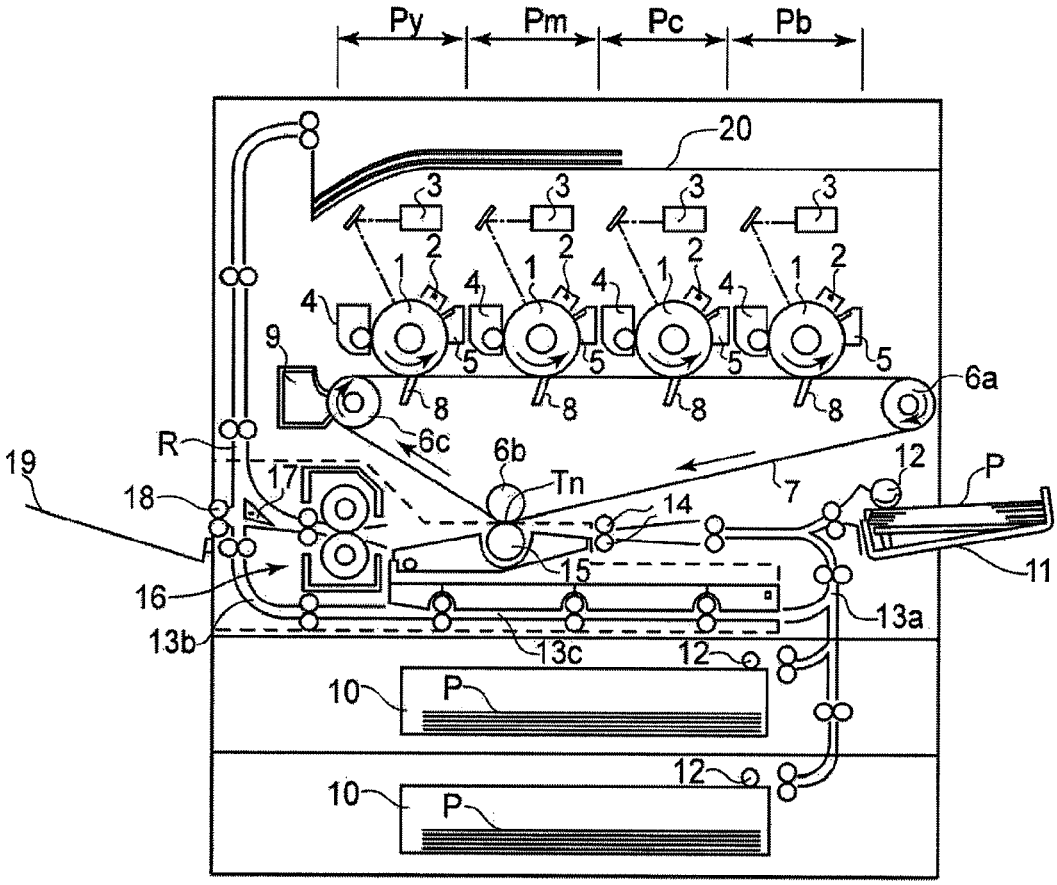
FIG. 1 is a schematic view of an embodiment of an image forming apparatus.

FIG. 1 is a schematic illustration of an embodiment of an image forming apparatus to which an image heating apparatus according to the present invention is mountable as an image fixing device. This image forming apparatus is a color printer of an electrophotographic type.

The image forming apparatus in Embodiment 1 is configured so that four color toner images different in color can be formed through processes of charging, exposure, development, and transfer by first, second, third and fourth image forming stations (portions) Py, Pm, Pc and Pb provided side by side inside the image forming apparatus.

The image forming apparatus in Embodiment 1 executes a predetermined image forming sequence depending on an image forming signal output from an external device (not shown), such as a host computer, and then performs an image forming operation in accordance with the image forming sequence. Specifically, the respective image forming stations are successively driven, so that each of the photosensitive drums 1 as an image bearing member is rotated in a direction indicated by an arrow at a predetermined peripheral speed (process speed). An intermediary transfer belt 7 stretched and extended around a driving roller 6*a*, a follower roller 6*b* and a tension roller 6*c* so as to face the respective photosensitive drums 1 of the image forming stations Py, Pm, Pc and Pb is rotated by the driving roller 6*a* in a direction indicated by an arrow at a peripheral speed corresponding to the peripheral (rotational) speed of each photosensitive drum 1.

First, at the image forming station Py for yellow as a first color, the surface of the photosensitive drum 1 is electrically charged uniformly to a predetermined polarity and a predetermined potential by a charging device 2. Then, the charged surface of the photosensitive drum 1 is subjected to scanning exposure with laser light emitted from an exposure device 3 corresponding to image information from the external device. As a result, an electrostatic latent image is formed on the surface of the photosensitive drum 1 corresponding to the image information. Then the latent image is developed with a yellow toner (developer) by a developing device 4, so that a yellow toner image (developer image) is formed on the surface of the photosensitive drum 1. Similar steps of charging, exposure and development are also performed at the image forming station Pm for magenta as a second color, the image forming station Pc for cyan as a third color, and the image forming station Pb for black as a fourth color.

The respective color toner images formed on the surfaces of the respective photosensitive drums 1 at the image forming stations Py, Pm, Pc and Pb are successively transferred onto an outer peripheral surface of the intermediary transfer belt 7 in a superposition manner by primary transfer blades 8 disposed opposite to the respective photosensitive drums 1 through the intermediary transfer belt 7. As a result, a full-color toner image is carried on the surface of the intermediary transfer belt 7.

Separately, a recording material P is sent by a feeding roller 12 from a sheet-feeding cassette 10 or a manual feeding type recording material tray 11 to registration rollers 14 along a conveying path 13*a*. Then, the recording material P is sent by the registration rollers 14 to a secondary transfer nip Tn between the intermediary transfer belt 7 and a secondary transfer roller 15 and is nip-conveyed in the secondary transfer nip Tn. During the nip-conveying process, the full-color toner image on the surface of the intermediary transfer belt 7 is transferred onto the recording material P by the secondary transfer roller 15.

The recording material P carrying thereon the full-color toner image which has not been fixed is introduced into a fixing device 16. Then, the recording material P is nip-conveyed in a nip described later, so that the unfixed full-color toner image is heated and fixed on the recording material P.

In the case of forming an image only on one surface of the recording material P, the recording material P is discharged, through switching of a switching flapper 17, on a discharging tray 19 provided on a side surface of the image forming apparatus via a discharging roller 18 or on a discharging tray 20 provided at an upper surface of the image forming apparatus. In the case where the switching flapper 17 is located at a position of a broken line, the recording material P is discharged on the discharging tray 19 with face up (with the image upward). In the case where the switching flapper 17 is located at the indicated position (of a solid line), the recording material P is discharged on the discharging tray 20 with face down (with the image downward).

In the case of forming the image on both surfaces of the recording material P, the recording material P on which the toner image has been fixed by the fixing device 16 is guided upward by the switching flapper 17 located at the indicated position. Then, when a trailing end of the recording material P reaches a reversing point R, the recording material P is switch back-conveyed along a conveying path 13*b* to be reversed. Thereafter, the recording material P is conveyed along a conveying path 13*c* for both-side (surface) image formation and then is subjected to the same process as that in the case of one-side (surface) image formation, so that the toner image is formed on the other surface of the recording material P and then the recording material P is discharged on the discharging tray 19 or on the discharging tray 20.

The photosensitive drum 1 after the toner image transfer is subjected to removal of untransferred toner remaining on the surface of the photosensitive drum 1 by a drum cleaner 5 and then is subjected to subsequent image formation.

The intermediary transfer belt 7 after the full-color toner image transfer is subjected to removal of untransferred toner remaining on the surface of the intermediary transfer belt 7 by a belt cleaner 9 and then is subjected to subsequent image formation.

(2) Fixing Device

In the following description, with respect to the fixing device as the image heating apparatus and the members constituting the fixing device, a longitudinal direction refers to a direction perpendicular to a recording material conveying direction in a plane of the recording material. In this embodiment, the longitudinal direction coincides with a rotational axis of the belt member. A widthwise direction refers to a direction parallel to the recording material conveying direction in the plane of the recording material. A length refers to a dimension with respect to the longitudinal direction. A width refers to a dimension with respect to the widthwise direction.

Further, with respect to the recording material, a widthwise direction refers to a direction perpendicular to the recording material conveying direction in the plane of the recording material. A width (of the recording material) refers to a dimension (of the recording material) with respect to the widthwise direction.

Figure 2:
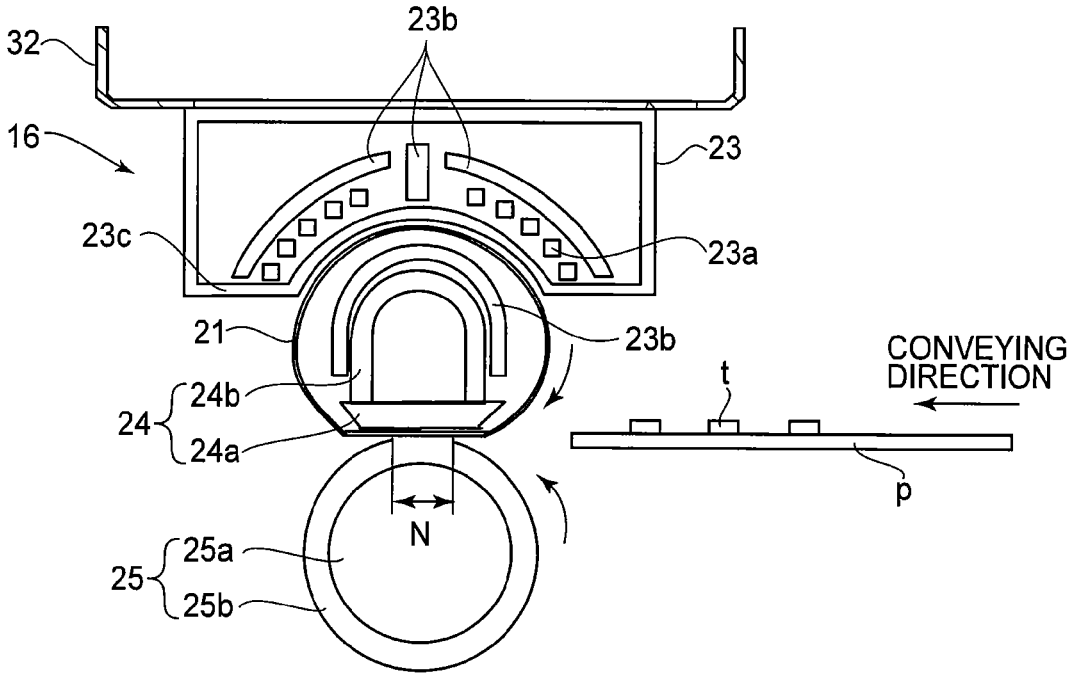
FIG. 2 is a schematic cross-sectional view of an embodiment of a fixing device.
Figure 4:
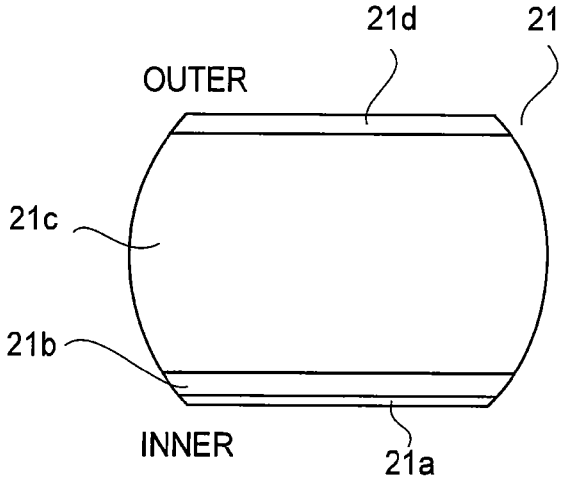
FIG. 4 is a schematic view for illustrating a layer structure of the fixing belt.
Figure 3:
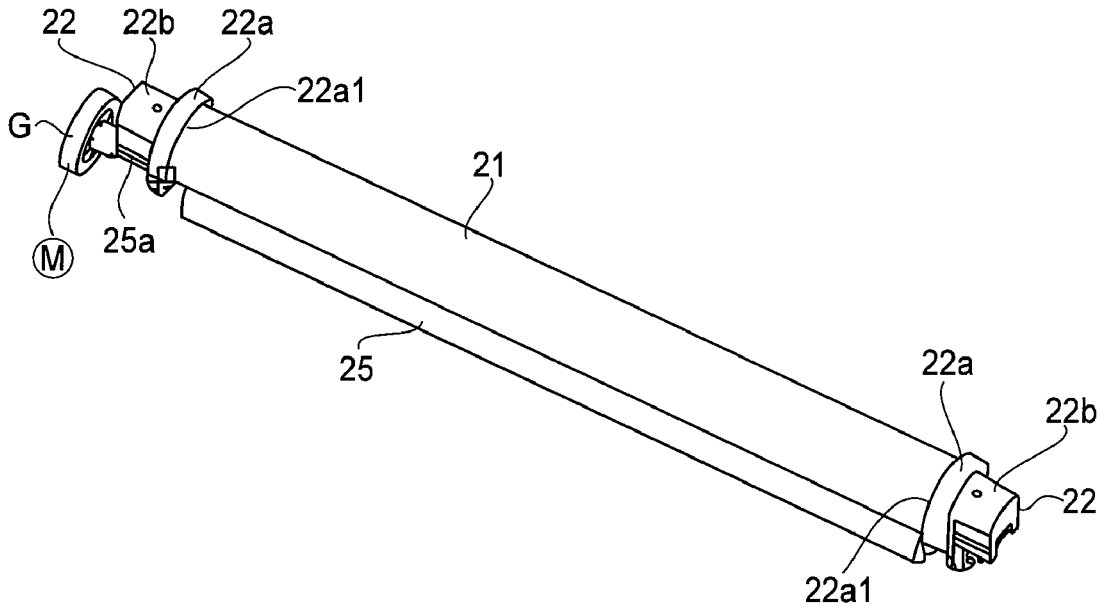
FIG. 3 is a perspective view showing a positional relationship between a fixing belt and a fixing flange of the fixing device.

FIG. 2 is a schematic cross-sectional view of an embodiment of the fixing device 16. FIG. 3 is a perspective view showing a positional relationship among a fixing belt 21 and a fixing flange 22 of the fixing device 16, and a pressing roller 25. FIG. 4 is a schematic view for illustrating a layer structure of the fixing belt 21.

The fixing device 16 in Embodiment 1 is a belt fixing device of an electromagnetic induction heating type. This belt fixing device of the electromagnetic induction heating type uses an electromagnetic induction heat generating element as a heating element. When a magnetic field is exerted on this electromagnetic induction heat generating element by a magnetic field generating means, an eddy current is generated in the electromagnetic induction heat generating element and Joule heat is generated due to the eddy current. The belt fixing device of the electromagnetic induction heating type imparts heat to the recording material, as a material to be heated, by the Joule heat, thus heat-fixing an unfixed toner image on the surface of the recording material.

The fixing device 16 in Embodiment 1 includes the fixing belt (belt member) 21 as a cylindrical belt member having an electroconductive layer (electromagnetic induction heat generating element) 21*b*, a pair of fixing flanges 22 and 22 as a holding member, and a coil unit 23 including a coil. The fixing device 16 also includes a pressing stay 24 as a first pressing member and the pressing roller 25 as a second pressing member. The fixing device 16 is configured to subject the fixing belt 21 to the electromagnetic induction heating from the outside of the fixing belt 21 by the coil unit. Each of the fixing belt 21, the coil unit 23, the pressing stay 24 and the pressing roller 25 is an elongated member extending in the longitudinal direction.

(2-1) Coil Unit

The coil unit 23 is provided outside the fixing belt 21 while keeping a gap of about 0.5 mm to about 2 mm between it and an outer surface of the fixing belt 21. This coil unit 23 includes an exciting coil 23*a*, a magnetic core 23*b*, and a holder 23*c* for holding the coil 23*a* and the core 23*b*.

The holder 23*c* is an elongated box-like member extending in the longitudinal direction of the fixing belt 21 and is held by a coil unit holding plate 32 (FIG. 6) along the longitudinal direction of the fixing belt 21. A lower surface of the holder 23*c* on the fixing belt 21 surface side is formed in a dome shape so as to follow the surface of the fixing belt 21 and opposes the surface of the fixing belt 21 with the above-described gap.

The coil 23*a* has an elongated elliptical shape extending in the longitudinal direction of the fixing belt 21 with a substantially reversed ship's bottom-like cross section. This shape is such a shape that the coil 23*a* follows the shape of the fixing belt 21 when the pressing stay 24 is located at an image heating position. The coil 23*a* is disposed inside the holder 23*c* so as to follow the surface of the fixing belt 21. As a core wire of the coil 23*a*, Litz wire prepared by bundling approximately 80-160 strands of fine wires having a diameter of 0.1-0.3 mm is used. As the fine wires, insulation coating electric wires are used. The Litz wire is wound 8 to 12 times around the core 23*b* to constitute the coil 23*a* to be used. To the coil 23*a*, an exciting circuit (not shown) is connected so that an alternating current can be supplied from the exciting circuit to the coil 23*a*.

The core 23*b* formed of a ferromagnetic material is configured to surround the coil 23*a* and a winding center position of the coil 23*a*. The core 23*b* has the function of efficiently introducing AC magnetic flux generated from the coil 23*a* into the electroconductive layer 21*b* of the fixing belt 21. That is, core 23*b* enhances the efficiency of the exciting circuit formed by the coil 23*a* and the electroconductive layer 21*b*. As a material for the core 23*b*, those such as ferrite having high magnetic permeability and low residual magnetic flux density may preferably be used. In order to efficiently provide the AC magnetic flux generated from the coil 23*a* to the electroconductive layer 21*b* of the fixing belt 21, another core 23*b* formed of the ferromagnetic material is provided inside the fixing belt 21 so as to oppose the above-described core 23*b* via the fixing belt 21. This core 23*b* (in the fixing belt 21) is disposed between a pressure holding member 24*a*, described later, of the pressing stay 24 and an inner peripheral surface (inner surface) of the fixing belt 21.

(2-2) Fixing Belt

The fixing belt 21 is an endless cylindrical member having heat resistivity and flexibility. The fixing belt 21 is a complex layer belt including, from the inner surface side to the outer surface side, an inner layer 21*a*, the electroconductive layer 21*b*, an elastic layer 21*c* and a surface parting layer 21*d* (FIG. 4).

The electroconductive layer 21*b* causes induction heat generation by the action of electromagnetic induction of the magnetic field (magnetic flux) generated by the coil unit 23. As the electroconductive layer 21*b*, an electroconductive layer (metal layer) formed in a thickness of about 50 μm to about 100 μm by using a metal material such as iron, cobalt, nickel, copper, or chromium, is used. Further, by using ferromagnetic metal (metal having high magnetic permeability) such as iron as the material for the electroconductive layer 21*b*, it is possible to confine a larger amount of the magnetic field generated by the coil unit 23 within the metal. That is, the magnetic flux density can be increased, so that the eddy current can be generated at the metal surface to cause the fixing belt 21 to efficiently generate heat. In this embodiment (Embodiment 1), as the electroconductive layer 21*b*, a layer of nickel is used having a high electrical conductivity and is formed in a small thickness of about 50 μm.

The elastic layer 21*c* is formed of a predetermined material suitable as the elastic layer for the fixing belt 21 and is provided on the electroconductive layer 21*b*.

The surface parting layer 21*d* directly contacts an unfixed toner image t carried on the recording material P. For that reason, as a material for the surface parting layer 21*d*, it is necessary to use a material having a good parting property. Specifically, as the surface parting layer 21*d*, it is possible to use, e.g., layers of tetrafluoroethylene-perfluoroalkylvinyl ether copolymer (PFA), polytetrafluoroethylene (PTFE), and a silicone copolymer, and composite layers of these materials. The surface parting layer 21*d* formed of the material appropriately selected from the above-described materials is provided in a thickness of 1-50 μm on the outer peripheral surface of the elastic layer 21*c*. With respect to the thickness of the surface parting layer 21*d*, when the thickness is excessively small, the durability, in terms of an anti-wearing property, is poor and thus the lifetime durability of the fixing belt 21 is shortened. On the other hand, when the thickness is excessively large, the thermal capacity of the fixing belt 21 becomes large, so that the warm-up time is undesirably increased.

In this embodiment (Embodiment 1), as the surface parting layer 21*d* of the fixing belt 21, a 30 μm-thick layer of PFA is used.

(2-3) Pressing Roller

The pressing roller 25 having the heat resistivity includes a round shaft-like core metal 25*a* and an elastic layer 25*b* provided in a roller shape on the outer peripheral surface of the core metal 25*a*. As a material for the elastic layer 25*b*, a heat-resistant rubber such as a silicone rubber or a fluorine-containing rubber, a foam member of the silicon rubber, or the like is used. The pressing roller 25 is provided in parallel to the fixing belt 21 on an opposite side to the coil unit 23 with respect to the fixing belt 21. Both longitudinal end portions of the core metal 25*a* are rotatably held by side plates 16F1 and 16F1 (FIG. 6) of a device frame 16 through shaft-supporting members.

(2-4) Pressing Stay

The pressing stay 24 is a member having the heat resistivity and is provided inside the fixing belt 21. The pressing stay 24 includes a flat plate-like sliding portion 24*a* contactable to the inner surface of the fixing belt 21 on the opposite side to the coil unit 23 and includes a pressing portion 24*b* which has a reversed U-shaped cross section and is provided on the sliding portion 24*a*. The sliding portion 24*a* is provided parallel to the recording material conveying direction (FIG. 1) and the pressing portion 24*b* is provided at a central portion of the sliding portion 24*a* with respect to the widthwise direction.

(2-5) Fixing Flange

The fixing flanges 22 and 22 are held by the side plates 16F1 and 16F1 (FIG. 6) of the device frame 16 so as to oppose the longitudinal end portions of the pressing portion 24*b* of the pressing stay 24. The fixing flanges 22 and 22 include substrate (base portions) 22*a* and 22*a* opposing the longitudinal end portions of the fixing belt 21. Each of the substrates 22*a* and 22*a* is provided with an engaging recess (not shown). By engaging the longitudinal end portions of the pressing portion 24 in the engaging recesses, the fixing flanges 22 and 22 hold the pressing portion 24*b* of the pressing stay 24.

The substrates 22*a* and 22*a* have inner wall surfaces 22*a*1 and 22*a*1, facing the fixing belt 21, which are provided with belt holding portions (not shown) projected toward the fixing belt 21. The substrates 22*a* and 22*a* include fixing belt portions to be pressed 22*b* and 22*b* which are provided on outer wall surfaces of the substrates 22*a* and 22*a* on the opposite side to the fixing belt 21 and are projected toward the opposite side to the fixing belt 21. The belt holding portions are engaged with portions located inside the longitudinal end portions of the fixing belt 21, thus rotatably holding the fixing belt 21. That is, the fixing flanges 22 and 22 support the fixing belt 21 from the inside of the fixing belt 21 at the longitudinal end portions of the fixing belt 21 and guide the cylindrical shape of the fixing belt 21. The inner wall surfaces 22*a*1 and 22*a*1 function as preventing surfaces for preventing movement of the fixing belt 21 by contact with longitudinal end surfaces of the fixing belt 21 when the fixing belt 21 is moved in the longitudinal direction.

The portions to be pressed 22*b* and 22*b* of the fixing flanges 22 and 22 are pressed by pressing levers 33 and 33 described later. A pressing force of the pressing levers 33 and 33 is exerted on the sliding portion 24*a* through the pressing portion 24*b* of the pressing stay 24. The sliding portion 24*a* supplied with the pressing force of the pressing levers 33 and 33 presses the surface of the fixing belt 21 against the surface of the pressing roller 25. As a result, the fixing belt 21 is deformed so as to follow the surface shape of the sliding portion 24*a* and at the same time the elastic layer 25*b* of the pressing roller 25 is also elastically deformed so as to follow the surface shape of the sliding portion 24*a*. As a result, a nip (fixing nip) N with a predetermined width is formed between the fixing belt 21 surface and the pressing roller 25 surface. In contact with the portions to be pressed 22*b* and 22*b*, projections 32*a* and 32*a* of a coil unit holding plate 32 described later are provided. As a result, the above-described gap for causing the electroconductive layer 21*b* to generate heat by the action of the generated magnetic flux from the coil 23*a* is created between the fixing belt 21 surface and the lower surface of the holder 23*c* of the coil unit 23.

(3) Heat-Fixing Operation of Fixing Device

In this embodiment (Embodiment 1), the fixing device 16 rotates forward (normally) by a fixing motor M as a driving source in accordance with a print signal to rotate a driving gear G (FIG. 3), provided to a longitudinal end of the core metal 25*a* of the pressing roller 25, in a predetermined direction. As a result, the pressing roller 25 rotates in a direction indicated by an arrow at a predetermined peripheral speed (process speed). The rotation of the pressing roller 25 causes a frictional force between the pressing roller 25 surface and the fixing belt 21 surface in the nip N, so that a driving force is transmitted to the fixing belt 21. As a result, the fixing belt 21 is rotated by the rotation of the pressing roller 25 while sliding on the sliding portion 24*a* at its inner surface. A lubricant such as a grease is applied between the sliding portion 24*a* and the inner surface of the fixing belt 21, thus improving a sliding property between the pressing stay 24 and the inner surface of the fixing belt 21.

Further, in accordance with the print signal, the alternating current is supplied to the coil 23*a* of the coil unit 23 by the exciting circuit. As a result, the coil 23*a* generates the AC magnetic flux, which is introduced into the core 23*b* to generate the eddy current in the fixing belt 21. The eddy current generates Joule heat by the specific resistance of the fixing belt 21. That is, by supplying the alternating current to the coil 23*a*, the fixing belt 21 is placed in an electromagnetic induction heat generation state. A temperature of the fixing belt 21 is detected by a thermistor as a temperature detecting member. An output signal (a temperature detection signal for the fixing belt 21) from the thermistor is input into the control portion. The control portion effects ON/OFF control of the exciting circuit on the basis of the output signal so as to keep the temperature of the fixing belt 21 at a level of a predetermined fixing temperature (a target temperature).

In a state in which the rotations of the pressing roller 25 and the fixing belt 21 are stabilized and also the temperature of the fixing belt 21 is kept at the level of the predetermined fixing temperature, the recording material P carrying thereon the unfixed toner image t is introduced into the nip N, in which the recording material P is nip-conveyed between the fixing belt 21 surface and the pressing roller 25 surface. During the conveying process, the toner image t is heat-fixed on the recording material P by being subjected to the heat of the fixing belt 21 and the pressure in the nip N. The recording material P coming out of the nip N is separated from the fixing belt 21 surface, thus being discharged from the nip N.

(4) Deformation of Fixing Device During Pressure-Release

Figure 5:
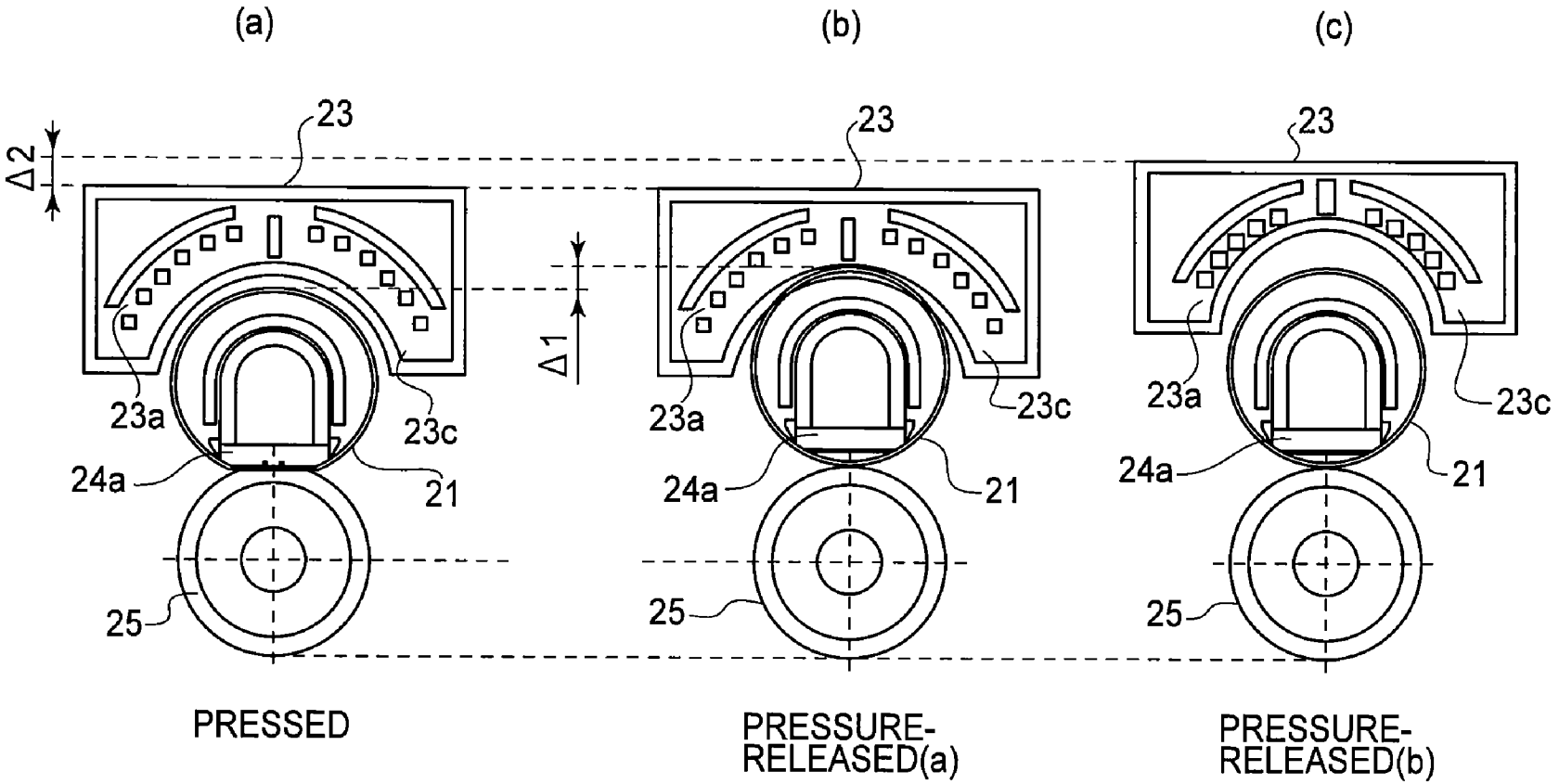
FIGS. 5(*a*) to 5(*c*) are schematic views each showing a cross-sectional shape of the fixing belt.

FIG. 5(*a*) is a schematic view showing a cross-sectional shape of the fixing belt 21 during pressure application. FIG. 5(*b*) is a schematic view showing a cross-sectional shape of the fixing belt 21 during pressure-release (a) in which the pressure application to the fixing belt 21 is released by operating the pressing stay 24. FIG. 5(*c*) is a schematic view showing a cross-sectional shape of the fixing belt 21 during pressure-release (b) in which the pressure application to the fixing belt 21 is released by operating the pressing stay 24 and the coil unit 23.

In the fixing device in this embodiment (Embodiment 1), the cross-sectional shape of the fixing belt 21 during the pressure application is changed from a substantially true circular shape before the pressure application to a partly flattened elliptical shape extending in the widthwise direction of the pressing stay 24 due to the nipping between the pressing stay 24 and the pressing roller 25 (FIG. 5(*a*)). In order to enhance the heat generating efficiency of the fixing belt 21 by the induction heating, the cross-sectional shape of the coil unit 23 on the fixing belt 21 side (the lower surface shape of the holder 23*c*) follows the elliptical shape of the fixing belt 21 surface during the pressure application. Further, the coil unit 23 provided outside the fixing belt 21 keeps the gap of about 0.5 mm to about 2 mm between it and the fixing belt 21 surface.

In the fixing device in this embodiment, when the jam clearance (operation) of the recording material P is performed, the pressing stay 24 is moved apart from the fixing belt 21 by a conventional predetermined pressure changing means to release the pressure application to the fixing belt 21. In this case, however, there is a possibility that the fixing belt 21 surface contacts the lower surface of the holder 23*c* of the coil unit 23 since the state of the fixing belt 21 is to be returned to the original circular shape state due to rigidity of the fixing belt 21 itself. In this state, when the jam clearance is performed, there is a possibility that the fixing belt 21 surface is abraded to damage the fixing belt 21.

The present inventor has studied on the fixing belt 21 constituted as follows. In the fixing belt 21, a layer of Ni having an inner diameter of 30 mm and a thickness of 50 μm was used as the electroconductive layer 21*b* and a 30 μm-thick polyimide (PI) film is used as the inner layer 21*a*. Further, a 300 μm-thick silicone rubber layer was used as the elastic layer 21*c* and a 40 μm-thick PFA layer was used as the surface parting layer. Deformation of the fixing belt 21 was measured when the fixing belt 21 was pressed against the pressing roller 25 with a pressing force of 600 N. As a result, a movement distance Δ1 of the fixing belt 21 surface between during the pressure application shown in FIG. 5(*a*) and during the pressure-release shown in FIG. 5(*b*) was about 1.0 mm. The movement distance Δ1 corresponds to that due to deformation of the fixing belt 21. In order to increase the heat generating efficiency, the fixing belt 21 and the coil unit 23 during the pressure application were brought near to each other so as to provide a gap therebetween of not more than 1.0 mm. In that case, when the pressure application of the pressing roller 25 to the fixing belt 21 is released, the fixing belt 21 contacts (interferes with) the coil unit 23. Therefore, the separation alone of the pressing roller 25 from the fixing belt is insufficient.

Therefore, in the fixing device 16 in this embodiment (of the present invention), in the surface of the pressure-release shown in FIG. 5(*c*), a pressuring and pressure-releasing mechanism which is a moving mechanism capable of moving the coil unit 23 away from the fixing belt 21 by a movement distance Δ (>Δ1) so that the coil unit 23 does not contact the fixing belt 21 is provided. When the state of the fixing belt 21 is changed from the state of the pressure application to the state of the pressure-release, the coil unit 23 and the fixing flanges 22 and 22 are configured so that these members can be operated to be separated from the fixing belt 21 in the indicated order. As a result, even when the shape of the fixing belt 21 is restored to the cylindrical shape before the deformation by the change in state from the state of the pressure application to the state of the pressure-release, it is possible to avoid the contact between the fixing belt 21 and the coil unit 23. Therefore, it is possible to not only satisfy the heat generating efficiency of the fixing belt 21 by the coil unit 23 but also prevent the damage of the fixing belt 21 due to the contact of the fixing belt 21 with the coil unit 23.

(5) Pressuring and Pressure-Releasing Mechanism

Figure 6:
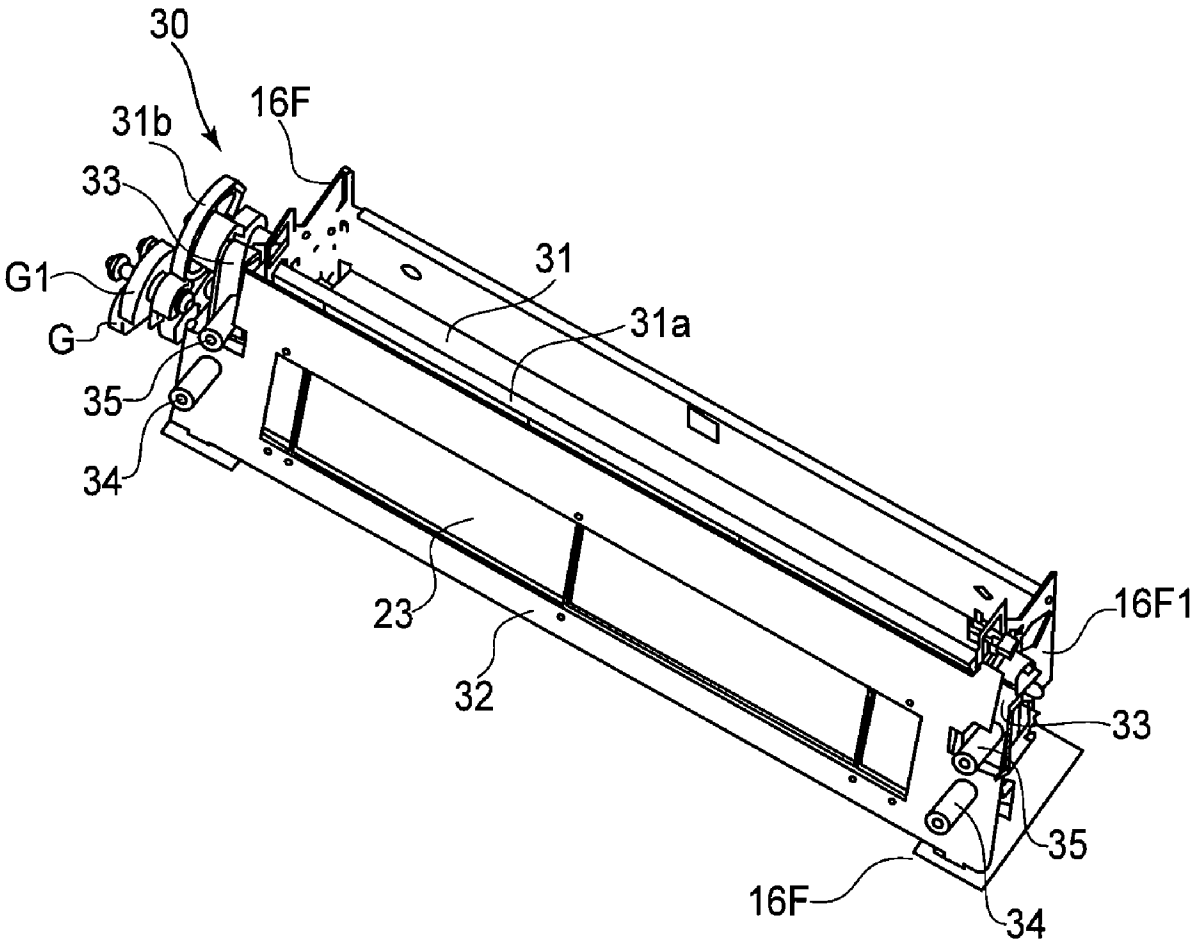
FIG. 6 is a perspective view of an outer appearance of an entire pressuring and pressure-releasing mechanism.
Figure 7:
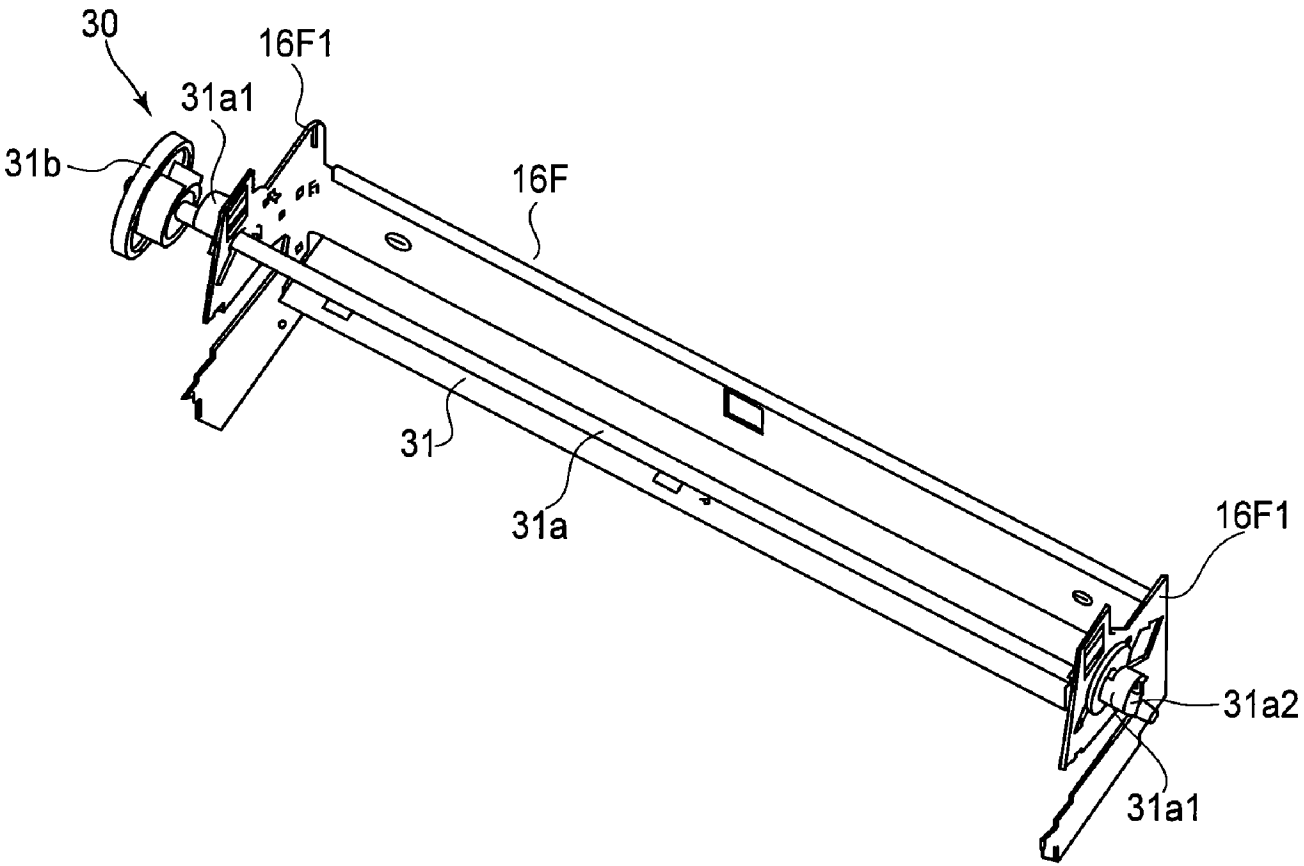
FIG. 7 is a perspective view for illustrating a rotational driving shaft of the pressuring and pressure-releasing mechanism.
Figure 8:
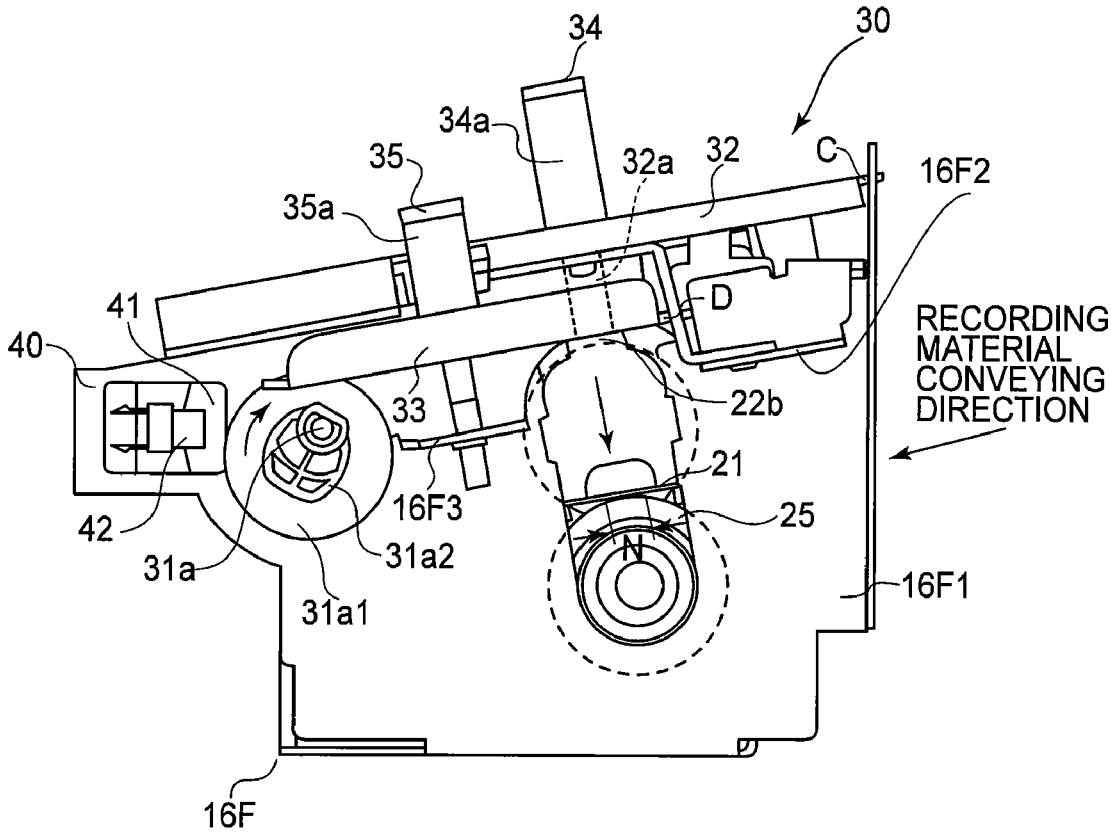
FIG. 8 is a schematic view for illustrating a pressure-releasing operation of the pressuring and pressure-releasing mechanism.

FIG. 6 is a perspective view of an outer appearance of the entire pressuring and pressure-releasing mechanism 30 as a pressure changing mechanism (pressure-releasing mechanism). FIG. 7 is a perspective view for illustrating a rotational driving shaft 31 of the pressuring and pressure-releasing mechanism 30. FIG. 8 is a schematic view for illustrating a pressure releasing operation of the pressuring and pressure-releasing mechanism 30.

The pressuring and pressure-releasing mechanism 30 as a pressuring and pressure-releasing means includes the rotational driving shaft 31 as a rotatable member, the coil unit holding plate 32 as a coil unit holding member, and a part of pressing levers 33 and 33 as a pressing member. The pressuring and pressure-releasing mechanism 30 further includes a pair of first spring screws 34 and 34 as a first pressing means and a pair of second spring screws 35 and 35 as a second pressing means.

The rotational driving shaft 31 includes a shaft 31*a* provided in parallel to the fixing belt 21. The shaft 31*a* is rotatably held by the side plates 16F1 and 16F1 of the device frame 16F at both longitudinal end portions thereof (FIG. 7). The shaft 31*a* is provided with a first larger eccentric cam 31*a*1 and a second smaller eccentric cam 31*a*2 at each of the both longitudinal end portions thereof located outside the side plates 16F1 and 16F1 (FIG. 7 and FIG. 8). Further, at one longitudinal end portions of the shaft 31*a*, a pressure-releasing gear 31*b* is provided. The rotational driving shaft 31 is provided downstream of the nip N with respect to the recording material conveying direction.

The coil unit holding plate 32 holding the coil unit 23 is rotatably held by the side plates 16F1 and 16F1 of the device frame 16F at both longitudinal end portions thereof at a position upstream of the nip N with respect to the recording material conveying direction. That is, the contact holding plate 32 is configured so as to be operable with respect to a direction in which the coil unit holding plate 32 is separated from the fixing belt 21 at the both longitudinal end portions thereof as a supporting point C. The projections 32*a* and 32*a* are provided in the neighborhood of a substantially central portion of the coil unit holding plate 32 with respect to the widthwise direction of the coil unit holding plate 32 and contact the portions to be pressed 22*b* and 22*b* of the fixing flanges 22 and 22. The substantially widthwise central portion of the coil unit holding plate 32 is pressed against the fixing flanges 22 and 22 by springs 34*a* and 34*a* of the first spring screws 34 and 34 supported by first fixed portions 16F2 and 16F2 of the side plates 16F1 and 16F1. As a result, the coil unit holding plate keeps the above-described predetermined gap between the coil unit 23 and the fixing belt 21. Therefore, with respect to the coil unit holding plate 32, a first position refers to a position in which the coil unit holding plate 32 contacts the fixing flanges 22 and 22 and keeps the predetermined gap for permitting the heat generation of the electroconductive layer 21*b* by the action of the generated magnetic flux from the coil 23*a*.

The pressing levers 33 and 33 are rotatably held by fixed portions 16F3 and 16F3 at both longitudinal end portions thereof on a downstream side of the nip N with respect to the recording material conveying direction. That is, the pressing levers 33 and 33 are configured so that the pressing levers 33 and 33 are operable with respect to a direction in which the pressing levers 33 and 33 are separated from the fixing belt 21 at the both longitudinal end portions as a supporting point D. The pressing levers 33 and 33 contact the portions to be pressed 22*b* and 22*b* of the fixing flanges 22 and 22 between the substantially widthwise central portions of the pressing levers 33 and 33 and both longitudinal end portions of the pressing levers 33 and 33. The substantially widthwise central portions of the pressing levers 33 and 33 are pressed against the fixing flanges 22 and 22 by springs 35*a* and 35*a* of the second spring screws 35 and 35 supported by the second fixed portions 16F3 and 16F3 of the side plates 16F1 and 16F1. By the fixing flanges 22 and 22, the sliding portion 24*a* of the pressing stay 24 presses the fixing belt 21 against the pressing roller 25 to deform the fixing belt 21 so as to form the nip N. Therefore, with respect to the pressing levers 33 and 33, a first position refers to a position in which the fixing belt 21 is deformed so as to form the nip N by applying the pressure to the fixing flanges 22 and 22 so as to press the fixing belt 21 against the pressing roller 25.

(6) Pressure-Releasing Operation of Pressuring and Pressure-Releasing Mechanism With reference to FIG. 8 and FIG. 9, a pressure-releasing operation of the pressuring and pressure-releasing mechanism 30 will be described. In this embodiment, the pressuring and pressure-releasing mechanism 30 functions as not only the pressure-releasing means but also the moving means for moving the coil unit 23.

Figure 9:
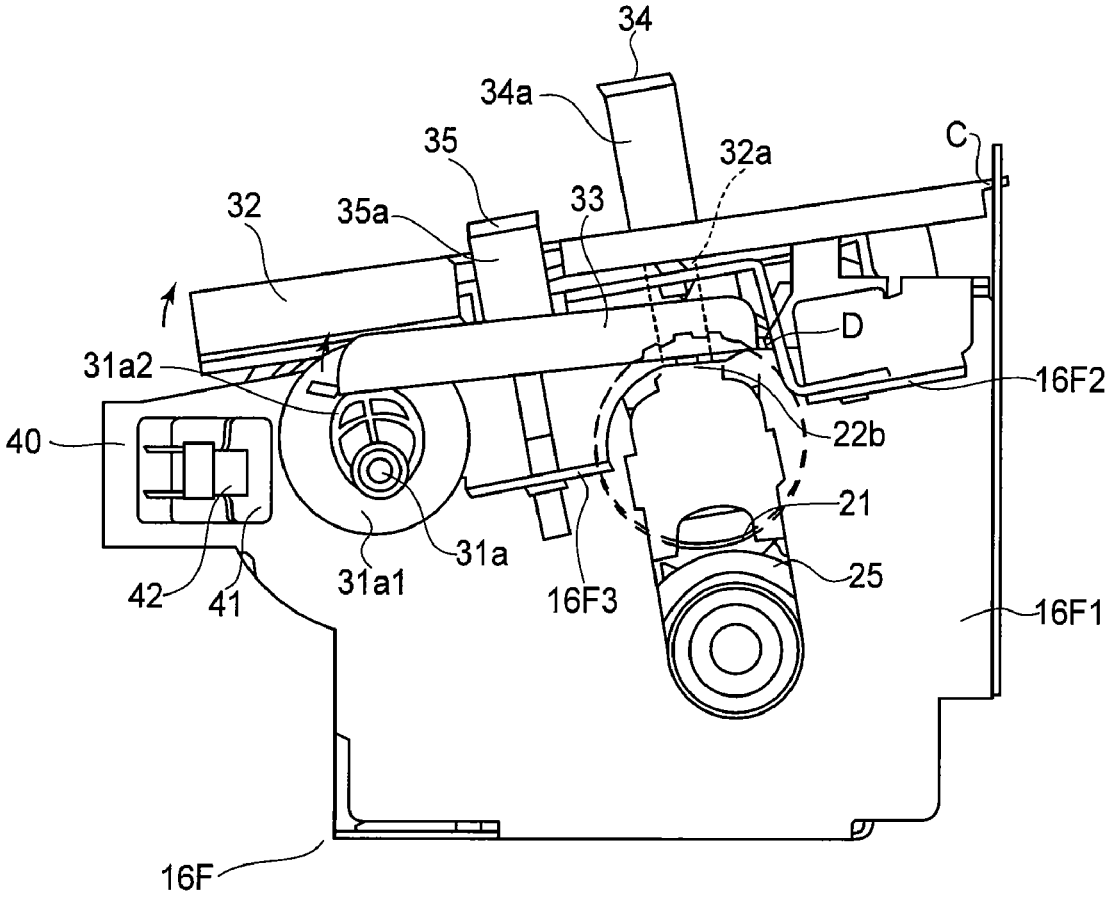
FIG. 9 is a schematic view for illustrating a state in which a gap between a coil unit and the fixing belt is made maximum by moving the coil unit away from the fixing belt.

FIG. 9 is a schematic view showing a state in which the coil unit 23 is moved away from the fixing belt 21 by the pressuring and pressure-releasing mechanism 30 to maximize the gap.

In accordance with a predetermined signal during the jam clearance, the fixing motor is reversely rotated to rotate a pressure-releasing gear 31*b* of the rotational driving shaft 31, through a drive transmission gear G1, in a predetermined by a predetermined amount. Here, with respect to the rotational driving shaft 31, the predetermined amount refers to an amount of the rotation of the rotational driving shaft 31 corresponding to the movement distance Δ2 by which the coil unit 23 is moved away from the fixing belt 21. In interrelation with the rotation of the pressure-releasing gear 31*b*, the shaft 31*a* is rotated. Correspondingly thereto, the first larger eccentric cams 31*a*1 and the second smaller eccentric cams 31*a*2 are rotated in a direction indicated by an arrow (FIG. 8).

First, by the rotation of the first larger eccentric cams 31*a*1, the outer peripheral surfaces of the first larger eccentric cams 31*a*1 contact the coil unit holding plate 32 on the downstream side of the nip N with respect to the recording material conveying direction. When the first larger eccentric cams 31*a*1 are further rotated, the first larger eccentric cams 31*a*1 rotationally move the coil unit holding plate 32 about the supporting point C in the direction in which the coil unit holding plate 32 is moved apart from the fixing belt 21 against the pressing force of the springs 34*a* of the first spring screws 34. By the rotational movement of the coil unit holding plate 32, the projections 32*a* and 32*a* are started to be separated from the portions to be pressed 22*b* and 22*b* of the fixing flanges 22 and 22. Further, by the rotational movement of the coil unit holding plate 32, the coil unit 23 is rotationally moved in a direction in which the coil unit 23 is moved away from the fixing belt 21. By the rotational movement of the coil unit 23, the gap between the coil unit 23 and the fixing belt 21 is gradually increased.

When the second smaller eccentric cams 31*a*2 are also rotated by the rotation of the first larger eccentric cams 31*a*1, the outer peripheral surfaces of the second smaller eccentric cams 31*a*2 contact the pressing levers 33 and 33 on the downstream side of the nip N with respect to the recording material conveying direction. The contact between the surfaces of the second smaller eccentric cams 31*a*2 and the pressing levers 33 and 33 is caused to occur in a process in which the coil unit holding plate 32 is moved from the first position to a second position by the above-described first larger eccentric cam 31*a*1. When the second smaller eccentric cams 31*a*2 are further rotated, the second smaller eccentric cams 31*a*2 rotationally move the pressing levers 33 and 33 about the supporting point D in the direction in which the pressing levers 33 and 33 are moved apart from the portions to be pressed 22*b* and 22*b* of the fixing flanges 22 and 22 against the pressing force of the springs 35*a* of the second spring screws 35. By the rotational movement of the pressing levers 33 and 33, a degree of the pressure application to the fixing belt 21 is gradually alleviated, so that the shape of the fixing belt 21 is started to be restored to the original cylindrical shape by the rigidity of the fixing belt 21 itself.

When the first larger eccentric cams 31*a*1 are further rotated to maximize a distance from the shaft 31*a* to the surface of the first larger eccentric cams 31*a*1 contacting the coil unit holding plate 32, the predetermined gap between the coil unit 23 and the fixing belt 21 is also maximized. At this time, the drive of the fixing motor is stopped. The stopping of the fixing motor is performed after a lapse of a preset time from the start of the reverse rotation of the fixing motor. In order to stop the fixing motor, it is also possible to employ a method in which the number of rotations is counted or a method in which a pulse is counted in the case where the fixing motor is a pulse motor. In this embodiment, the maximum of the above-described gap is set at a predetermined value at which the fixing belt 21 surface does not contact the lower surface of the coil unit 23 when the pressure application to the fixing belt 21 is released. Therefore, with respect to the coil unit holding plate 32, the position in which the distance from the shaft 31*a* of the rotational driving shaft 31 to the surface of the first larger eccentric cams 31*a*1 is maximized is set as the second position. That is, with respect to the coil unit holding plate 32, the second position is a position in which the coil unit holding plate 32 keeps the gap larger than that at the above-described first position. The rotational driving shaft 31 operates the coil unit holding plate 32 so as to move from the first position to the second position by the rotation of the first larger eccentric cams 31*a*1 when the pressure application to the fixing flanges 22 and 22 is released.

When the second smaller eccentric cams 31*a*2 are further rotated by the rotation of the first larger eccentric cams 31*a*1 to maximize the distance from the shaft 31*a* to the surfaces of the second smaller eccentric cams 31*a*2 contacting the pressing levers 33 and 33, the pressing levers 33 and 33 are further rotated to be separated from the portions to be pressed 22*b* and 22*b*. Thus, the pressure application from the fixing belt 21 to the pressing roller 25 by the sliding portion 24*a* of the pressing stay 24 is released. As a result, the shape of the fixing belt 21 is restored to the original cylindrical shape and the shape of the pressing roller 25 is also restored to the original true circular shape. Therefore, with respect to the pressing levers 33 and 33, the position in which the pressure application to the fixing flanges 22 and 22 is released to restore the shape of the fixing belt 21 to the cylindrical shape before the deformation is set as a second position. That is, with respect to the pressing levers 33 and 33, the second position refers to the position in which the pressure application to the fixing flanges 22 and 22 is released to restore the shape of the fixing belt 21 to that before the deformation.

As described above, by reversely rotating the rotational driving shaft 31, the coil unit holding plate 32 is moved from the first position (thereof) to the second position (thereof) through the first larger eccentric cams 31*a*1. In a process of the movement of the coil unit holding plate 32 from the first position to the second position, the pressing levers 33 and 33 are moved from the first position (thereof) to the second position (thereof) through the second smaller eccentric cams 31*a*2. Therefore, even when the shape of the fixing belt 21 is restored to the cylindrical shape before the deformation, it is possible to avoid contact between the fixing belt 21 surface and the coil unit 23 lower surface. Thus, it is possible to prevent the damage of the fixing belt 21.

Figure 10:
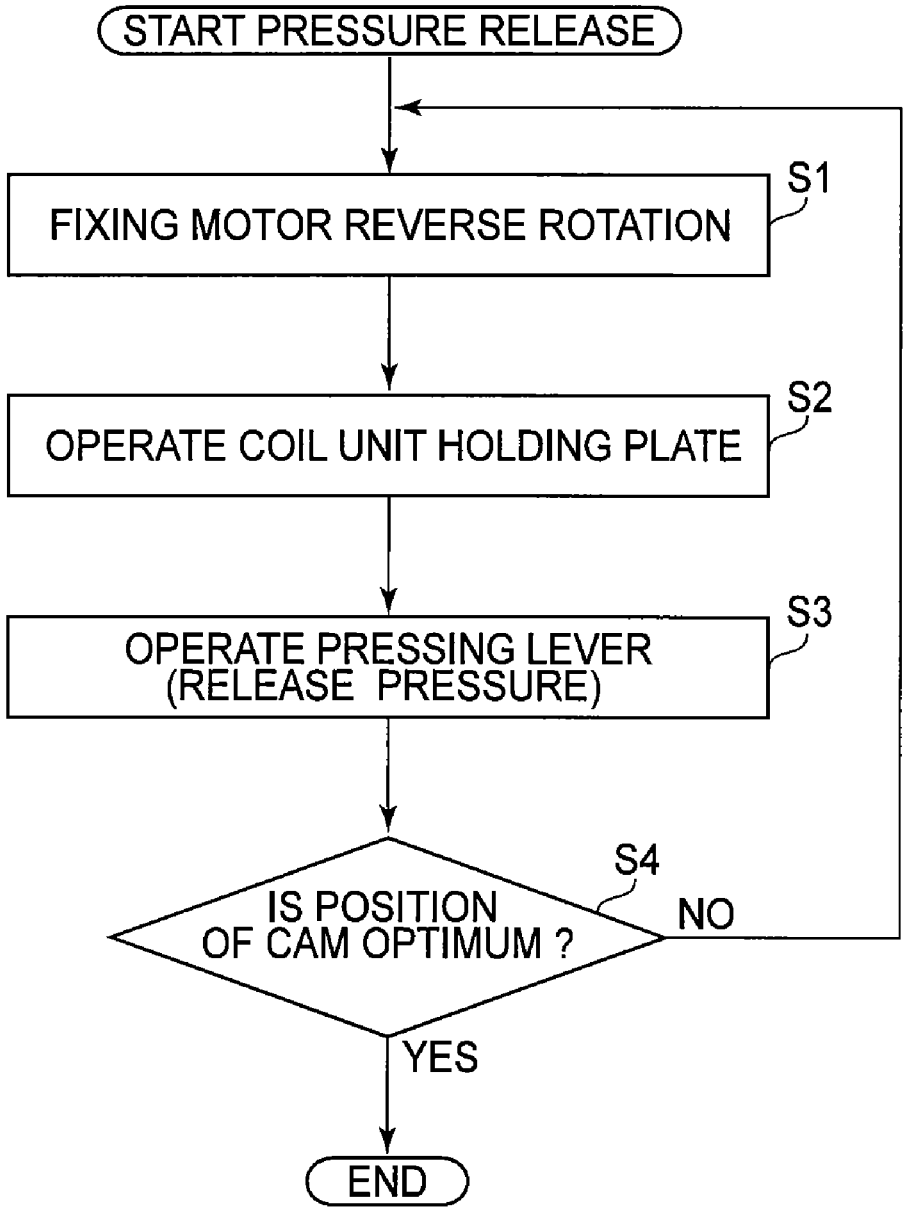
FIG. 10 is a flow chart showing an example of a procedure of the pressure-releasing operation of the pressuring and pressure-releasing mechanism.

FIG. 10 is a flow chart showing an example of a procedure of the pressure-releasing operation of the pressuring and pressure-releasing mechanism 30. This pressure-releasing operation is performed during non-image formation in which the image is not formed on the recording material. The non-image formation may include not only a state in which the image forming operation is stopped due to an occurrence of an error such as jamming but also a state, such as a stand-by state, in which the image forming apparatus awaits an image forming signal.

In a step S1, the fixing motor is reversely rotated.

In step S2, the coil unit holding plate 32 is moved from the first position to the second position through the first larger eccentric cams 31*a*1 to keep the gap larger than that at the first position.

In a step S3, the pressing levers 33 and 33 are moved from the first position to the second position through the second smaller eccentric cams 31*a*2 to perform the pressure-release between the pressing roller 25 and the fixing belt 21.

In a step S4, whether or not the position of the first larger eccentric cams 31*a*1 is optimum is judged. In the case where the position of the first larger eccentric cams 31*a*1 is not optimum ("NO"), the procedure is returned to the step S1.

In this embodiment, in the fixing device 16, as a position detecting means 40 (FIG. 8), the side plate 16F1 is provided with a flag 41 for detecting a rotational position of the first larger eccentric cam 31*a*1 and with a flag sensor 42 for detecting the flag 41. On the basis of an output signal of the flag sensor 42, whether or not the position of the first larger eccentric cam 31*a*1 is optimum is judged by the control portion (the drive control means) for controlling the drive of the fixing motor.

When the state in which the pressing force exerted in the nip is released is restored to the state in which the pressing force is exerted in the nip, a reverse operation is performed. That is, after the pressing stay is moved so that the state of the pressing force which has been released is restored to the state in which the pressing force is exerted in the nip, the operation for moving the coil unit to the image forming position is performed.

In this embodiment, such a constitution that the coil unit is moved by the fixing motor to release the pressing force in the nip is employed but other constitutions may also be employed. For example, it is also possible to employ a constitution in which the pressing force in the nip cannot be released until the coil unit is moved when the lever operation is performed. It is further possible to employ a constitution in which a motor other than the fixing motor is used to move the coil unit and employ a constitution in which a pressure in the fixing nip is changed.

In this embodiment, the constitution in which the pressing stay is moved is employed but it is also possible to achieve the effect of the present invention by employing a similar constitution with respect to the coil unit movement even in the constitution in which the pressing roller is moved.

As described above, according to the present invention, even when the pressure application state between the belt member and the pressing member is released to restore the shape of the belt member to that before the deformation of the belt member, it is possible to provide an image heating apparatus capable of avoiding the contact between the belt member and the coil unit.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 257338/2008 filed Oct. 2, 2008, which is hereby incorporated by reference.

What is claimed is:

1. An image heating apparatus comprising:

a coil configured to generate magnetic flux;

a belt member, including an electroconductive layer configured to generate heat by the magnetic flux generated from said coil, configured to heat an image on a recording material by the heat generated by the electroconductive layer;

a first pressing member contactable to an inner surface of said belt member;

a second pressing member configured to press said belt member against said first pressing member to nip and convey the recording material;

a coil unit, including said coil, provided oppositely to an outer surface of said belt member;

a moving mechanism capable of moving said coil unit between a first position in which the image on the recording material is to be heated and a second position in which said coil unit is moved away from said belt member; and a pressure changing mechanism configured to change the pressure between said first pressing member and said second pressing member;

wherein said pressure changing mechanism starts to reduce the pressure between said first pressing member and said second pressing member after a start of an operation for moving said coil unit away from said belt member by said moving mechanism.

2. An apparatus according to claim 1, wherein a direction in which said coil unit is moved from the first position to the second position by said moving mechanism coincides with a direction in which said first pressing member is moved from a position in which the image on the recording material is heated to a position in which said first pressing member is moved away from the position in which the image on the recording material is heated, by said pressure changing mechanism.

3. An apparatus according to claim 1, wherein the amount of movement of said belt member between a position in which the pressure is reduced and a position in which the image on the recording material is heated is smaller than the amount of movement of said coil unit between the first position and the second position.

4. An apparatus according to claim 1, further comprising a driving source configured to transmit a driving force to said second pressing member, and wherein said belt member is rotated by transmitting the driving force from said second pressing member to said belt member.

5. An apparatus according to claim 1, wherein when said moving mechanism moves said coil unit from the second position to the first position, a moving operation of said coil unit is started after an operation of increasing the pressure between said first pressing member and said second pressing member is performed by said pressure changing mechanism.

6. An image heating apparatus comprising:

a coil configured to generate magnetic flux;

a belt member, including an electroconductive layer configured to generate heat by the magnetic flux generated from said coil, configured to heat an image on a recording material by the heat generated by the electroconductive layer;

a first pressing member contactable to an inner surface of said belt member;

a second pressing member configured to press said belt member against said first pressing member to nip and convey the recording material;

a coil unit, including said coil, provided oppositely to an outer surface of said belt member;

a moving mechanism capable of moving said coil unit from a first position in which the image on the recording material is to be heated to a second position in which said coil unit is moved away from said belt member; and a pressure changing mechanism configured to change the pressure between said first pressing member and said second pressing member, wherein said moving mechanism operates, when the pressure between said first pressing member and said second pressing member is reduced so as to be smaller than the pressure between said first pressing member and said second pressing member during which the image on the recording material is heated, so that an operation for moving said coil unit away from the first position is started before a start of an operation of said pressure changing mechanism for reducing the pressure between said first pressing member and second pressing member.

7. An apparatus according to claim 6, wherein a direction in which said coil unit is moved from the first position to the second position by said moving mechanism coincides with a direction in which said first pressing member is moved from a position in which the image on the recording material is heated to a position in which said first pressing member is moved away from the position in which the image on the recording material is heated, by said pressure changing mechanism.

8. An apparatus according to claim 6, wherein the amount of movement of said belt member between a position in which the pressure is reduced and a position in which the image on the recording material is heated is smaller than the amount of movement of said coil unit from the first position to the second position.

9. An apparatus according to claim 6, further comprising a driving source configured to transmit a driving force to said second pressing member, and wherein said belt member is rotated by transmitting the driving force from said second pressing member to said belt member.

10. An apparatus according to claim 6, wherein when said moving mechanism moves said coil unit from the second position to the first position, a moving operation of said coil unit is started after an operation of increasing the pressure between said first pressing member and said second pressing member is performed by said pressure changing mechanism.

* * * * *